US008162714B2

(12) United States Patent
Yang

(10) Patent No.: US 8,162,714 B2
(45) Date of Patent: Apr. 24, 2012

(54) SIMULATED EYE

(75) Inventor: Song-Ling Yang, Shenzhen (CN)

(73) Assignees: Hong Fu Jin Precision Industry (Shen-Zhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 317 days.

(21) Appl. No.: 12/560,344

(22) Filed: Sep. 15, 2009

(65) Prior Publication Data

US 2010/0120327 A1 May 13, 2010

(30) Foreign Application Priority Data

Nov. 12, 2008 (CN) ..... 2008 1 0305514

(51) Int. Cl.
*A63H 3/38* (2006.01)

(52) U.S. Cl. ..... 446/392; 446/389

(58) Field of Classification Search ..... 446/389, 446/392, 267; 623/4.1; 40/406, 407, 416, 40/422, 427

See application file for complete search history.

(56) References Cited

U.S. PATENT DOCUMENTS

| | | | | |
|---|---|---|---|---|
| 4,332,039 | A * | 6/1982 | LaFuente | 623/6.64 |
| 4,507,099 | A * | 3/1985 | Kinberg | 446/389 |
| 5,108,427 | A * | 4/1992 | Majercik et al. | 623/5.12 |
| 5,900,923 | A * | 5/1999 | Prendergast et al. | 351/221 |
| 6,386,941 | B1 * | 5/2002 | Lin | 446/267 |
| 6,391,057 | B1 * | 5/2002 | Schleipman et al. | 623/6.64 |
| 7,485,025 | B2 * | 2/2009 | Schnuckle | 446/392 |
| 2008/0139082 | A1 * | 6/2008 | Schnuckle | 446/392 |

FOREIGN PATENT DOCUMENTS

GB 1392431 A * 4/1975

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

A simulated eye capable of replicating pupil dilation and contraction is provided. The simulated eye includes an eyeball, a simulated pupil, a piston assembly, and a driving device. The eyeball includes a transparent portion. The simulated pupil is viewable at the transparent portion, and is operationally filled with a colored liquid. The piston assembly is in communication with the simulated pupil for accommodating the colored liquid. The driving device is mechanically coupled to the transmission assembly for driving the piston assembly. When the driving device drives the piston assembly, a size of the simulated pupil filled with the colored liquid is changeable, replicating dilation and contraction.

14 Claims, 5 Drawing Sheets

SIMULATED EYE

BACKGROUND

1. Technical Field

The present disclosure relates to mechanical eyes replicas.

2. Description of Related Art

A typical replica of a human eye allows such simulations as the eyelid opening and closing. Accordingly, other simulation effects are needed to make the eyes more lifelike. Therefore, what is needed is a simulated eye capable of replicating human eye behavior.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
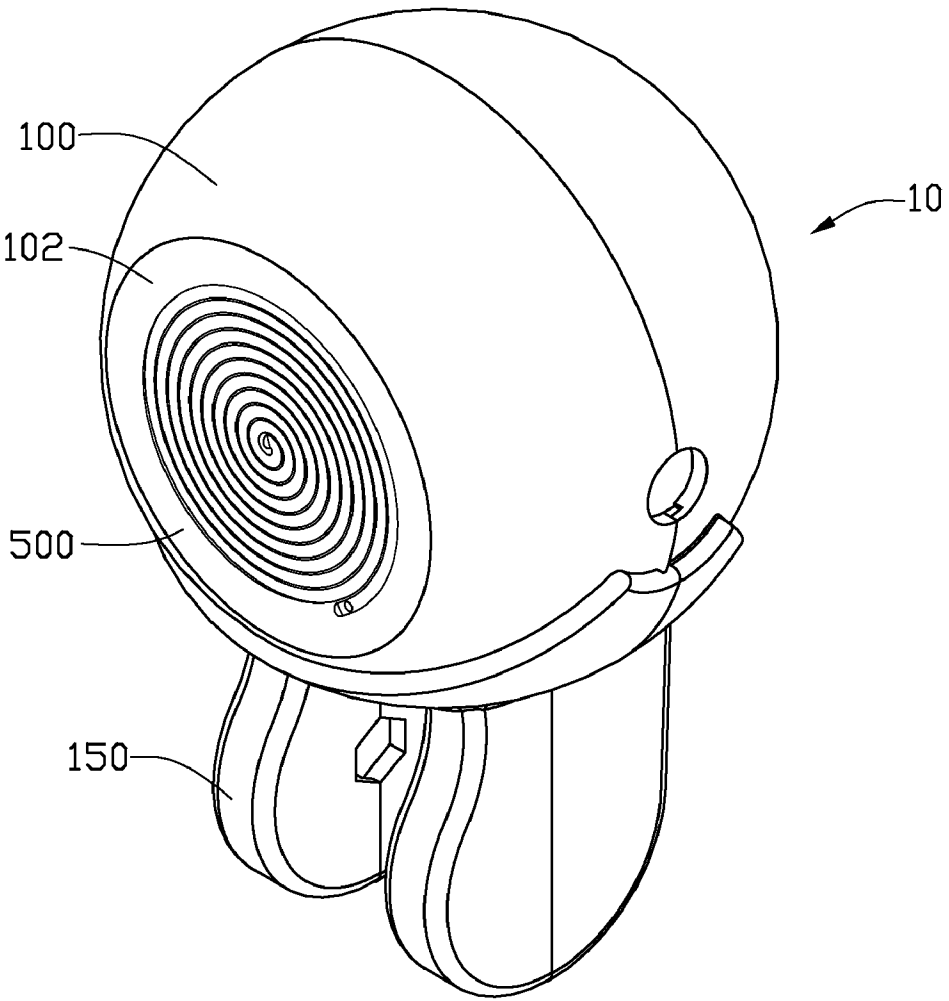
FIG. 1 is a perspective view of a simulated eye having a simulated pupil in accordance with one embodiment.

Referring to FIG. 1, a simulated eye 10 includes a spherical eyeball 100, a bracket 150, and a simulated pupil 500. The eyeball 100 is hollow and includes a transparent portion 102. The simulated pupil 500 is housed in the eyeball 100 and is viewable via the transparent portion 102. The bracket 150 is attached to and supports the eyeball 100. The simulated eye 10 may be fixed to a host via the bracket 150.

Figure 2:
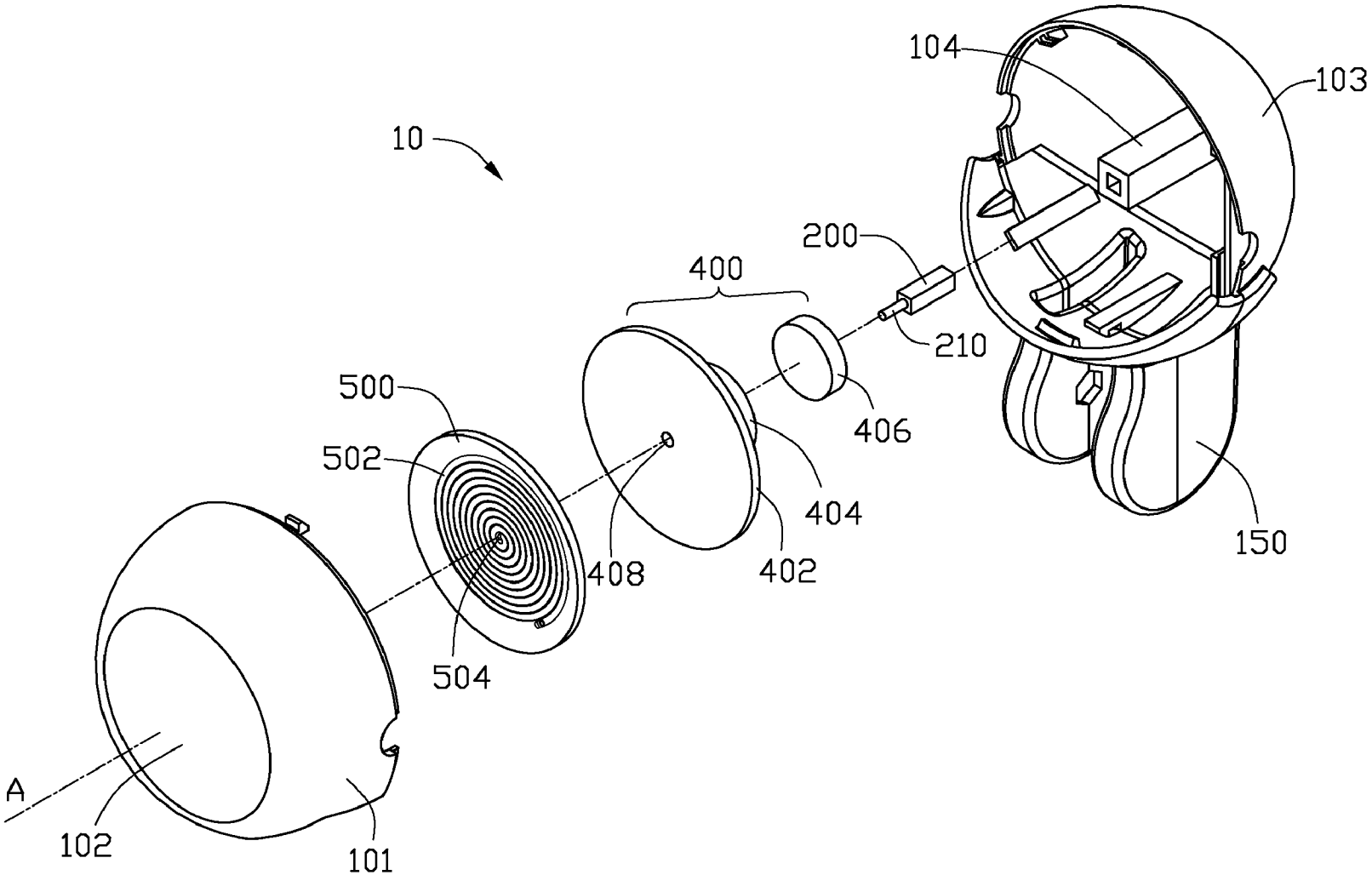
FIG. 2 is an exploded view of the simulated eye of FIG. 1.
Figure 3:
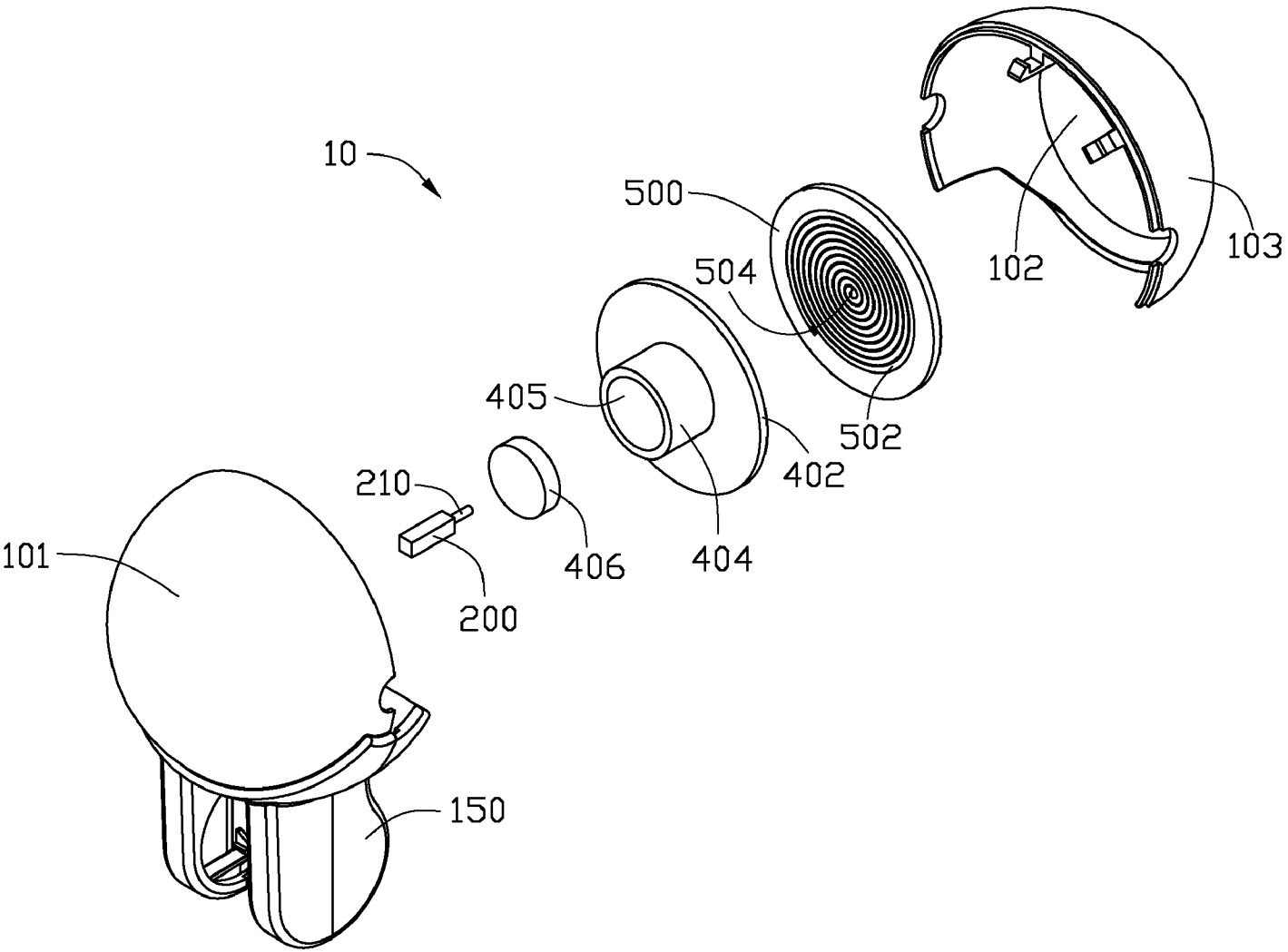
FIG. 3 is similar to FIG. 2, but viewed from another aspect.

Referring also to FIGS. 2 and 3, the eyeball 100 includes a front housing 101 and a rear housing 103 engaging therewith. A receiving member 104 is disposed on an inner surface of the rear housing 103. The simulated eye 10 further includes a driving device 200 and a piston assembly 400. The driving device 200 and the piston assembly 400 are housed in the eyeball 100. The piston assembly 400 is mechanically coupled to the driving device 200. The simulated pupil 500 is fixed to an inner surface of the front housing 101 and is further attached to the piston assembly 400.

The driving device 200 has a shaft 210 and is held in the receiving member 104. The driving device 200 moves the shaft 210 back and forth in an axial direction. The driving device 200 is electrically connected to a power source (not shown) supplying electric power thereto. The driving device 200 can be a servo motor or a step motor.

The piston assembly 400 includes a disc-shaped supporting member 402, a cylindrical member 404, and a cylindrical piston 406. A through hole 408 is defined in the center of the supporting member 402. The cylindrical member 404 protrudes perpendicular from the supporting member 402. A hollow cylindrical piston bore 405 is formed in the cylindrical member 404 for accommodating the cylindrical piston 406. The through hole 408 is in communication with the piston bore 405. The cylindrical piston 406 is accommodated tightly in the piston bore 405 and is movable back and forth in an axial direction to the cylindrical member 404. The piston bore 405 is further configured for receiving a colored liquid (not shown). The liquid may be black, blue, or other color.

The simulated pupil 500 fixed to the inner surface of the front housing 101 is round and transparent. A helical tubular portion 502 is disposed at a middle of the simulated pupil 500 to accommodate the colored liquid. The tubular portion 502 includes a helical tube with an opening end 504 disposed at a center point of the simulated pupil 500. The opening end 504 communicates with the through hole 408. The diameter of the simulated pupil 500 is equal to that of the supporting member 402.

During assembly, the simulated pupil 500 is attached tightly to a side surface of the supporting member 402. The opening end 504 communicates with the piston bore 405 via the through hole 408. The simulated pupil 500 together with the supporting member 402 is fixed to the inner surface of the front housing 101. The piston bore 405 is filled with the colored liquid, and the piston 406 is accommodated tightly therein, such that the colored liquid is closed in the piston bore 405 communicating with the tubular portion 502. The round piston 406 is further fixed to the shaft 210. The driving device 200 is held in the receiving member 104.

After assembly, the shaft 210, a center of the round piston 406, the through hole 408, the center point of the simulated pupil 500 and a center of the transparent portion 102 are aligned in a straight line A.

Figure 4:
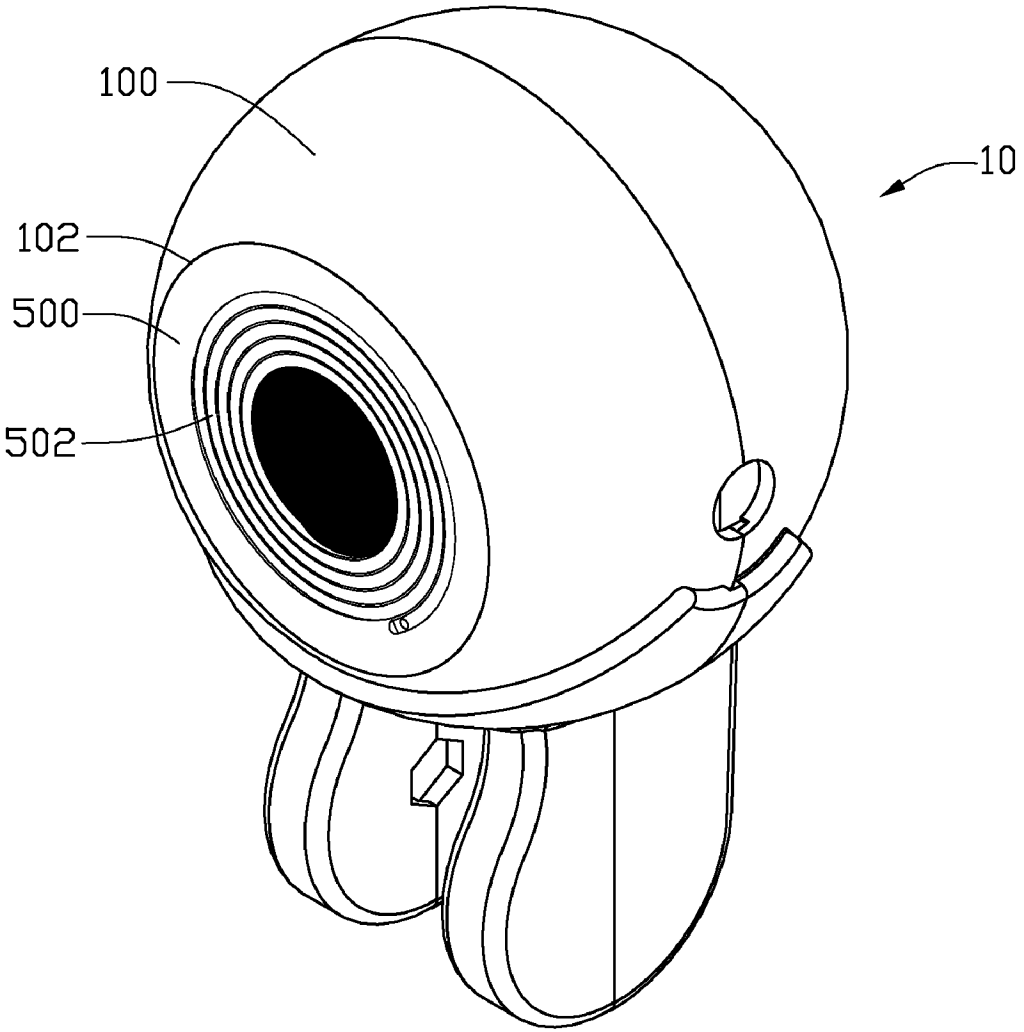
FIG. 4 is a perspective view of the simulated pupil of FIG. 1 in a contracted state.

Referring to FIG. 4, a portion of the tubular portion 502 is filled with colored liquid to replicate an eye in a normal state. In the normal state, the air (not shown) in the other portion of the tubular portion 502 contracts slightly.

Figure 5:
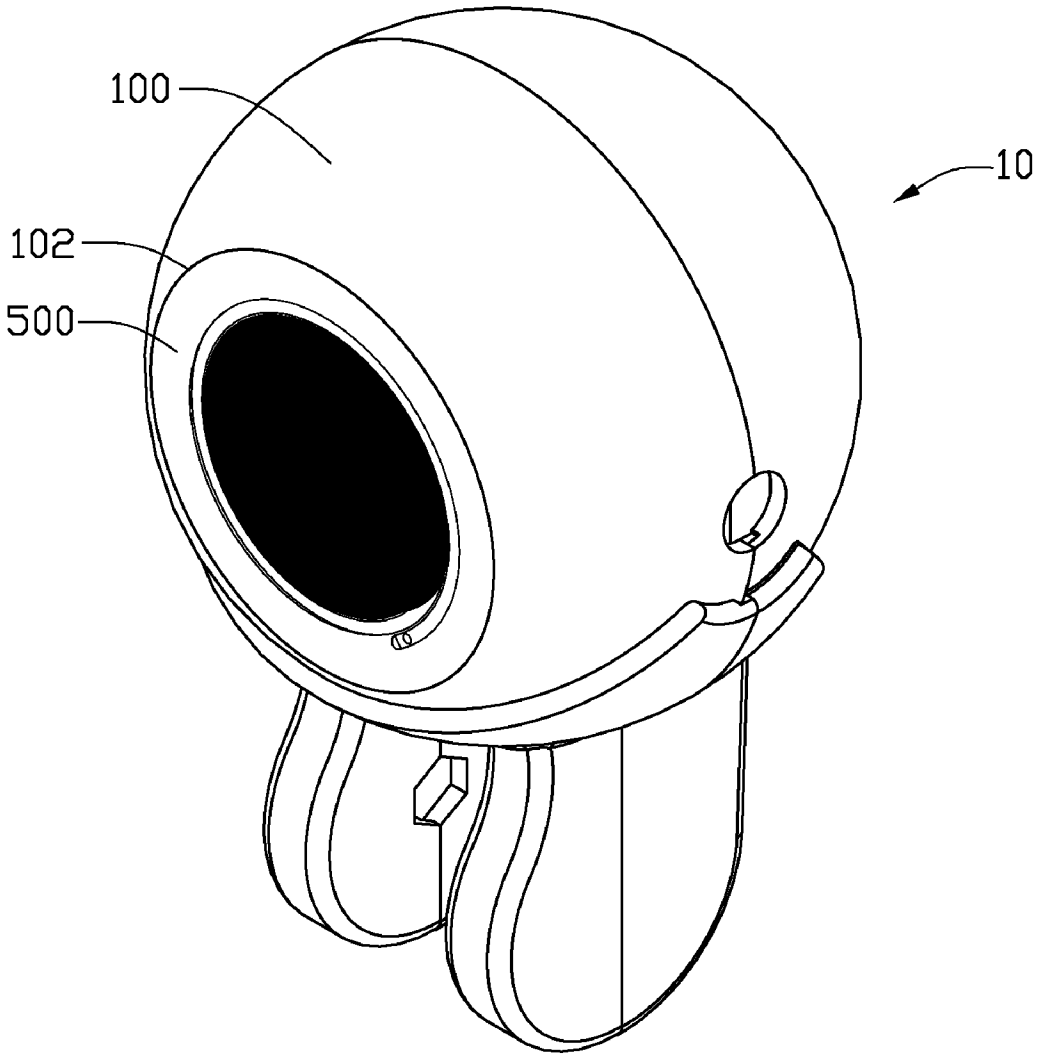
FIG. 5 is a perspective view of the simulated pupil of FIG. 1 in a dilated state.

Referring to FIG. 5, when the piston 406 is driven by the driving device 200 toward the simulated pupil 500, a portion of the colored liquid is pushed into the tubular portion 502, and accordingly, a colored area of the tubular portion 502 expands. As a result, the simulated eye 10 replicates dilation. Furthermore, as the tubular portion 502 is closed, accordingly, the air remaining in the tubular portion 502 is compressed by the colored liquid and increased pressure and decreased air volume.

When the driving device 200 is turned off, because the intensity of pressure of the compressed air is higher than the atmospheric pressure, the colored liquid is reflowed to the piston bore 405. The size of the tubular portion 502 containing colored liquid returns to its original size, and the simulated pupil 500 replicates contraction. Thus, by turning the driving device 200 on and off, the simulated pupil 500 replicates dilation and contraction.

Also, the piston 406 can be moved to the original position by the driving device 200, such that the colored liquid can reflow into the piston bore 405.

The tubular portion 502 can be a helical slot, helically defined on one side of the simulated pupil 500, with the beginning of the threaded slot at the center of the simulated pupil and in communication with the piston bore 405 via the through hole 408. After the simulated pupil 500 is attached tightly to the supporting member 402, the threaded slot and the piston bore 405 communicating therewith are closed. The colored liquid can also flow into the threaded slot while the piston 406 is driven by the driving device 200 to move toward the simulated pupil 500. In this condition, the simulative eye 10 replicates dilation. The colored liquid reflows into the piston bore 405 when the driving device 200 is turned off. In this condition, the simulative eye 10 replicates contraction.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

a simulated pupil comprising a helically disposed tubular portion operatively filled with a colored liquid and an opening end in the center of the tubular portion;

a transmission assembly comprising a cylindrical member defining a piston bore in communication with the opening end for accommodating the colored liquid and a piston slidably retained within the piston bore; and a driving device mechanically coupled to the piston for driving the piston toward and away from the simulated pupil;

wherein the colored liquid flows into the simulated pupil from the cylindrical member to replicate a dilated pupil when the piston is driven toward the simulated pupil; and the colored liquid reflows into the cylindrical member from the simulated pupil to replicate a contracted pupil when the driving device is turned off.

2. The simulated eye of claim 1, wherein the transmission assembly further comprises a supporting member, to which the simulated pupil is attached, the cylindrical member protruding perpendicular from the supporting member, and the simulated pupil opposite to the cylindrical member.

3. The simulated eye of claim 2, wherein the supporting member defines a through hole in communication with the piston bore and the opening end.

4. The simulated eye of claim 3, wherein the piston is movable back and forth in the piston bore, and the piston bore and the piston form a space for receiving the colored liquid.

5. The simulated eye of claim 1, further comprising an eyeball comprising a front portion and a rear portion, with a receiving portion disposed on an inner surface of the rear portion for holding the driving device.

6. The simulated eye of claim 5, wherein the transmission assembly further comprises a supporting member to which the simulated pupil is attached thereto and is fixed to an inner surface of the front portion.

7. The simulated eye of claim 1, further comprising an eyeball comprising a transparent portion, wherein the simulated eye is housed in the eyeball and viewable at the transparent portion.

8. The simulated eye of claim 7, further comprising a bracket attached to the eyeball for supporting the simulated eye.

9. A simulated eye capable of replicating pupil dilation and contraction, the simulated eye comprising:

a simulated pupil operationally filled with a colored liquid;

a transmission assembly in communication with the simulated pupil for accommodating the colored liquid; and a driving device mechanically coupled to the transmission assembly for driving the transmission assembly;

wherein when the driving device drives the transmission assembly, a volume of the colored liquid filled in the simulated pupil changes between states replicating dilation and contraction.

10. The simulated eye of claim 9, wherein the transmission assembly comprises a piston, a supporting member, and a cylindrical member, the piston mechanically coupled to the driving device and driven back and forth, the simulated pupil attached to the supporting member, the cylindrical member protruding perpendicular from the supporting member, and the simulated pupil opposite to the cylindrical member.

11. The simulated eye of claim 10, wherein a piston bore is defined in the cylindrical member for accommodating the piston, the piston bore and the piston form a receiving space for accommodating the colored liquid.

12. The simulated eye of claim 11, wherein the simulated pupil is transparent and comprises a tubular portion helically disposed in the simulated pupil and in communication with the piston bore.

13. The simulated eye of claim 12, wherein the tubular portion comprises an open end disposed substantially at a center of the simulated pupil, and is in communication with the piston bore via the open end.

14. The simulated eye of claim 9, further comprising an eyeball comprising a transparent portion, wherein the simulated eye is housed in the eyeball and viewable at the transparent portion.

* * * * *